US008925646B2

(12) United States Patent
Seith et al.

(10) Patent No.: US 8,925,646 B2
(45) Date of Patent: Jan. 6, 2015

(54) RIGHT ANGLE IMPACT TOOL

(75) Inventors: Warren Andrew Seith, Bethlehem, PA (US); Lucas James Taylor, Easton, PA (US)

(73) Assignee: Ingersoll-Rand Company, Davidson, NC (US)

( * ) Notice: Subject to any disclaimer, the term of this patent is extended or adjusted under 35 U.S.C. 154(b) by 734 days.

(21) Appl. No.: 13/033,241

(22) Filed: Feb. 23, 2011

(65) Prior Publication Data

US 2012/0211249 A1 Aug. 23, 2012

(51) Int. Cl.
*B25B 21/02* (2006.01)

(52) U.S. Cl.
CPC ..... *B25B 21/02* (2013.01); *B25B 21/023* (2013.01); *B25B 21/026* (2013.01)
USPC ..... 173/109; 173/216; 173/217; 173/48

(58) Field of Classification Search
CPC ..... B25B 21/02; B25B 21/023; B25B 21/026
USPC ..... 173/109, 216–217, 48
See application file for complete search history.

(56) References Cited

U.S. PATENT DOCUMENTS

| | | | | |
|---|---|---|---|---|
| 2,267,781 A | | 12/1941 | Albertson | |
| 2,585,486 A | * | 2/1952 | Mitchell | 173/93.6 |
| 3,181,672 A | | 5/1965 | Swanson | |
| 3,223,182 A | | 12/1965 | Mikiya | |
| 3,270,593 A | | 9/1966 | Kaman | |
| 3,352,368 A | | 11/1967 | Maffey, Jr. | |
| 3,380,539 A | | 4/1968 | Kaman | |
| 3,465,646 A | | 9/1969 | Kiester et al. | |
| 3,661,217 A | | 5/1972 | Maurer | |
| 3,848,680 A | | 11/1974 | Legler | |
| 3,949,944 A | | 4/1976 | Bent | |

(Continued)

FOREIGN PATENT DOCUMENTS

| | | |
|---|---|---|
| CN | 1494988 A | 5/2004 |
| EP | 2277469 A2 | 5/2005 |

(Continued)

OTHER PUBLICATIONS

PCT/US2012/25850 International Preliminary Report on Patentability mailed on Sep. 13, 2013 (27 pages).

(Continued)

*Primary Examiner* — Michelle Lopez
(74) *Attorney, Agent, or Firm* — Barnes & Thornburg LLP

(57) ABSTRACT

An angle impact tool includes a handle assembly extending along a first axis, a prime mover in the handle, an output shaft rotatable about the first axis, and a work attachment connected to the handle assembly. An output drive is supported in the work attachment for rotation about an output axis perpendicular to the first axis. A gear assembly including a spur gear is positioned within the work attachment to transfer torque from the prime mover about the first axis to the output drive about the output axis. An impact mechanism is positioned within the work attachment and includes a hammer and an anvil. The hammer rotates under the influence of the prime mover and is operable to periodically deliver an impact load to the anvil. The output drive rotates about the output axis under the influence of the impact load being transmitted to the output drive by the anvil.

7 Claims, 11 Drawing Sheets

(56) References Cited

U.S. PATENT DOCUMENTS 3,951,217 A 4/1976 Wallace et al.
4,173,828 A 11/1979 Lustig et al.
D256,980 S 9/1980 Adams et al.
4,222,443 A 9/1980 Chromy
4,235,850 A 11/1980 Otto, Jr.
4,287,795 A 9/1981 Curtiss
4,355,564 A 10/1982 Gidlund
4,379,492 A 4/1983 Hiraoka
4,403,679 A 9/1983 Snider
4,434,858 A 3/1984 Whitehouse
4,488,604 A 12/1984 Whitehouse
4,585,078 A 4/1986 Alexandrov et al.
4,625,999 A 12/1986 Valentine et al.
4,708,210 A 11/1987 Rahm
4,719,976 A 1/1988 Bleicher et al.
4,732,218 A 3/1988 Neumaier et al.
4,735,020 A 4/1988 Schulz et al.
4,740,144 A 4/1988 Biek
4,776,561 A 10/1988 Braunlich et al.
4,779,382 A 10/1988 Rudolf et al.
4,798,249 A 1/1989 Hoereth et al.
4,799,833 A * 1/1989 Pennison et al. ..... 408/132
4,867,250 A 9/1989 Ono
4,974,475 A 12/1990 Lord et al.
5,022,469 A 6/1991 Westerberg
D323,961 S 2/1992 Fushiya et al.
5,143,161 A * 9/1992 Vindez ..... 173/19
D335,808 S 5/1993 Bruno et al.
5,210,918 A 5/1993 Wozniak et al.
D339,726 S 9/1993 Bruno et al.
5,293,747 A 3/1994 Geiger
5,346,021 A 9/1994 Braunlich
5,346,024 A 9/1994 Geiger et al.
D352,645 S 11/1994 Ichikawa
5,443,196 A 8/1995 Burlington
5,471,898 A 12/1995 Forman
5,505,676 A 4/1996 Bookshar
D372,850 S 8/1996 Dubuque et al.
5,626,198 A 5/1997 Peterson
D380,949 S 7/1997 Sung
D388,678 S 1/1998 Bantly et al.
D393,580 S 4/1998 Bantly et al.
5,813,477 A 9/1998 Clay et al.
D400,771 S 11/1998 Smith et al.
D403,564 S 1/1999 Izumisawa
5,906,244 A 5/1999 Thompson et al.
D414,093 S 9/1999 Zurwelle
6,039,231 A 3/2000 White
6,044,917 A 4/2000 Brunhoelzl
6,047,779 A 4/2000 Wallace
6,053,080 A 4/2000 Kaneyama et al.
6,082,468 A 7/2000 Pusateri et al.
6,109,366 A 8/2000 Jansson et al.
D434,297 S 11/2000 Iritani et al.
D434,958 S 12/2000 Izumisawa
6,158,459 A 12/2000 Chang
D436,818 S 1/2001 Izumisawa
6,179,063 B1 1/2001 Borries et al.
D437,760 S 2/2001 Izumisawa
D441,628 S 5/2001 Bass et al.
6,250,399 B1 6/2001 Giardino
D444,363 S 7/2001 Hayakawa et al.
D447,029 S 8/2001 Sun et al.
6,338,389 B1 1/2002 Chang
D454,475 S 3/2002 Taga
D458,824 S 6/2002 Chen
D461,110 S 8/2002 Izumisawa
6,460,629 B2 10/2002 Bookshar et al.
6,461,088 B2 10/2002 Potter et al.
D465,982 S 11/2002 Taga
6,491,111 B1 12/2002 Livingston et al.
6,502,485 B1 1/2003 Salazar
6,505,690 B2 1/2003 Tokunaga
D469,673 S 2/2003 Sliker et al.
D472,782 S 4/2003 Pusateri et al.
6,561,284 B2 5/2003 Taga
D476,210 S 6/2003 Chen
D476,870 S 7/2003 Hayakawa et al.
D477,512 S 7/2003 Liu et al.
6,691,798 B1 2/2004 Lindsay
6,708,779 B2 3/2004 Taga
6,719,067 B2 4/2004 Taga
6,782,956 B1 8/2004 Seith et al.
D496,243 S 9/2004 Huang
6,789,447 B1 9/2004 Zinck
6,796,385 B1 9/2004 Cobzaru et al.
D497,529 S 10/2004 Price
D497,785 S 11/2004 Izumisawa
D497,787 S 11/2004 Liao
D502,071 S 2/2005 Snider
6,863,134 B2 3/2005 Seith et al.
6,863,135 B2 3/2005 Kamimura et al.
6,880,645 B2 4/2005 Izumisawa
6,883,619 B1 4/2005 Huang
6,889,778 B2 5/2005 Colangelo, III et al.
6,929,074 B1 8/2005 Lai
6,935,437 B2 8/2005 Izumisawa
D510,513 S 10/2005 Aglassinger
6,957,706 B2 10/2005 Burger et al.
D511,284 S 11/2005 Henssler et al.
6,968,908 B2 11/2005 Tokunaga et al.
D519,807 S 5/2006 Chen
D521,339 S 5/2006 Chen
7,036,605 B2 5/2006 Suzuki et al.
7,036,795 B2 5/2006 Izumisawa
7,040,414 B1 5/2006 Kuo
D525,502 S 7/2006 Chen
7,080,578 B2 7/2006 Izumisawa
7,089,833 B2 8/2006 Hamann et al.
7,109,675 B2 9/2006 Matsunaga et al.
D529,353 S 10/2006 Wong et al.
D530,171 S 10/2006 Baker
7,137,457 B2 11/2006 Frauhammer et al.
7,140,179 B2 11/2006 Bass et al.
D534,047 S 12/2006 Chi
D535,536 S 1/2007 Ghode et al.
7,174,971 B1 2/2007 Chen
7,191,849 B2 3/2007 Chen
D540,134 S 4/2007 Clay
D540,640 S 4/2007 Clay
7,311,155 B2 12/2007 Chang
D569,206 S 5/2008 Takahagi et al.
D572,991 S 7/2008 Chen
D580,248 S 11/2008 Rane et al.
7,461,704 B2 12/2008 Chen
D587,080 S 2/2009 Rane et al.
7,492,125 B2 2/2009 Serdynski et al.
D590,226 S 4/2009 Chu
D590,680 S 4/2009 Cole et al.
D590,681 S 4/2009 Palermo et al.
D591,127 S 4/2009 Taga
7,537,064 B2 5/2009 Milbourne et al.
D610,888 S 3/2010 Izumisawa et al.
D617,620 S 6/2010 Yaschur et al.
7,770,660 B2 8/2010 Schroeder et al.
7,779,931 B2 8/2010 Townsan
D624,380 S 9/2010 Rane et al.
7,828,072 B2 11/2010 Hashimoto et al.
7,836,797 B2 11/2010 Hecht et al.
7,886,840 B2 2/2011 Young et al.
8,267,192 B2 9/2012 Lopano et al.
8,297,373 B2 10/2012 Elger et al.
8,319,379 B2 11/2012 Onose et al.
8,347,979 B2 1/2013 Young et al.
2002/0035890 A1 3/2002 Kusachi et al.
2003/0075348 A1 4/2003 Eardley et al.
2004/0014411 A1 1/2004 Jonas
2004/0177980 A1 9/2004 Lucas
2005/0161243 A1 7/2005 Livingston et al.
2005/0279196 A1 12/2005 Hollar
2005/0279519 A1 12/2005 Clark
2006/0090914 A1 5/2006 Lin et al.
2006/0107798 A1 5/2006 Falzone
2007/0000674 A1 1/2007 Sell et al.

(56) References Cited

U.S. PATENT DOCUMENTS

| | | | | |
|---|---|---|---|---|
| 2007/0181322 | A1 | 8/2007 | Hansson et al. | |
| 2007/0289760 | A1 | 12/2007 | Sterling et al. | |
| 2008/0066937 | A1 | 3/2008 | Kobayashi | |
| 2008/0289843 | A1 * | 11/2008 | Townsan | 173/216 |
| 2009/0038816 | A1 | 2/2009 | Johnson et al. | |
| 2009/0272554 | A1 | 11/2009 | Young et al. | |
| 2009/0272556 | A1 | 11/2009 | Young et al. | |
| 2010/0107423 | A1 | 5/2010 | Bodine et al. | |
| 2010/0276168 | A1 | 11/2010 | Murthy et al. | |
| 2011/0139474 | A1 | 6/2011 | Seith et al. | |
| 2011/0233257 | A1 | 9/2011 | Fukinuki et al. | |
| 2012/0118596 | A1 | 5/2012 | Scott | |
| 2012/0138329 | A1 | 6/2012 | Sun et al. | |
| 2012/0152580 | A1 | 6/2012 | Mattson et al. | |
| 2013/0025900 | A1 | 1/2013 | Kokinelis et al. | |
| 2014/0008090 | A1 | 1/2014 | Kokinelis et al. | |
| 2014/0014385 | A1 | 1/2014 | Kosugi et al. | |

FOREIGN PATENT DOCUMENTS

| | | | | |
|---|---|---|---|---|
| EP | 2174754 | | 4/2010 | |
| JP | 3248296 | B2 | 10/1994 | |
| JP | 0911140 | A | 1/1997 | |
| JP | 3372398 | B2 | 1/1997 | |
| JP | 09011140 | A * | 1/1997 | B25B 21/02 |
| JP | 2001198853 | | 7/2001 | |
| WO | 99/49553 | A1 | 9/1999 | |
| WO | 2011002855 | | 1/2011 | |
| WO | 2011/111850 | A1 | 9/2011 | |
| WO | 2012/115921 | A2 | 8/2012 | |

OTHER PUBLICATIONS

Photographs of pneumatic tools, published prior to Apr. 18, 2006 (5 pages).

Stanley Air Tools Valve, published prior to May 5, 2008 (3 pages).

Hitachi Power Tools, Electric Tool Parts List, Cordless Angle Impact Driver, Model WH 10DCL, dated Aug. 29, 2008 (20 pages).

Makita, Cordless Angle Impact Drivers, Model 6940D, 6940DW, publicly available at least as early as Sep. 28, 2010 (27 pages).

Office Action from the United States Patent and Trademark Office for U.S. Appl. No. 13/033,217 dated Jan. 4, 2013 (12 pages).

International Search Report and Written Opinion for Application No. PCT/US2012/025850 dated Dec. 26, 2012 (8 pages).

First Office Action from the State Intellectual Property Office of China for Application No. CN200810188483.7 dated Dec. 25, 2012 (10 pages with English translation).

Sears Brands Management Corporation, "Operator's Manual, Craftsman Nextec, 12.0-Volt Lithium-Ion Cordless Right-Angle Impact Driver, Model No. 320.17562," 15 pages.

Ingersoll Rand CO., "2015MAX and 2025MAX Series Angle Air Impactool—Exploded View," 2010, 2 pages.

Makita U.S.A., Inc., "18V LXT® Lithium-Ion Cordless 3/8" Angle Impact Wrench, Model: BTL063Z: Parts Breakdown, Jul. 2007, 1 page.

* cited by examiner

RIGHT ANGLE IMPACT TOOL

FIELD OF THE INVENTION

The present invention relates to gear arrangements for angle impact tools.

SUMMARY

In one embodiment, the invention provides an angle impact tool including a handle assembly extending along a first axis and graspable by a user. A prime mover is positioned in the handle and includes an output shaft rotatable about the first axis. A work attachment is connected to the handle assembly. An output drive is supported in the work attachment for rotation about an output axis perpendicular to the first axis. A gear assembly is positioned within the work attachment. The gear assembly includes at least one spur gear and is operable to transfer torque from the prime mover about the first axis to the output drive about the output axis. An impact mechanism is positioned within the work attachment. The impact mechanism includes a hammer and an anvil. The hammer rotates under the influence of the prime mover and is operable to periodically deliver an impact load to the anvil. The output drive rotates about the output axis under the influence of the impact load being transmitted to the output drive by the anvil.

In another embodiment, the invention provides an angle impact tool including a handle assembly graspable by a user, and a prime mover at least partially contained within the handle assembly. The prime mover has a rotor rotatable about a first axis. An output drive is functionally coupled to the prime mover and selectively rotated in response to rotation of the rotor. The output drive defines an output axis about which the output drive rotates. The output axis is substantially perpendicular to the first axis. At least one bevel gear is functionally positioned between the rotor and the output drive. The at least one bevel gear is rotatable in response to rotation of the rotor. At least one spur gear is functionally positioned between the rotor and the output drive. The at least one spur gear is rotatable in response to rotation of the rotor. An impact mechanism is functionally positioned between the prime mover and the output drive. The impact mechanism selectively drives the output drive with impact forces in response to rotation of the rotor.

In yet another embodiment, the invention provides an angle impact tool including a handle assembly extending generally along a first axis and graspable by a user, a prime mover having an output shaft rotatable about the first axis, and an output drive functionally coupled to the prime mover and selectively rotated in response to rotation of the output shaft. The output drive defines an output axis about which the output drive rotates. The output axis is substantially perpendicular to the first axis. A first spur gear is functionally positioned between the prime mover and the impact mechanism. The first spur gear is rotatable in response to rotation of the output shaft. A second spur gear meshes with the first spur gear for rotation in response to rotation of the first spur gear. A third spur gear meshes with the second spur gear for rotation in response to rotation of the first and second spur gears. A first bevel gear is connected to the output shaft for rotation with the output shaft about the first axis. A second bevel gear is functionally positioned between the first bevel gear and the first spur gear, such that rotation of the first bevel gear about the first axis causes rotation of the second bevel gear to rotate about a second axis and the first spur gear to rotate about a third axis. The second axis and the third axis are substantially perpendicular to the first axis. An impact mechanism is functionally positioned between the prime mover and the output drive. The impact mechanism selectively drives the output drive in response to rotation of the output shaft. The impact mechanism includes a hammer functionally coupled to the output shaft for rotation with the output shaft, and an anvil functionally coupled to the output drive. The hammer is operable to impact the anvil to drive the output drive with impact forces in response to rotation of the output shaft.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
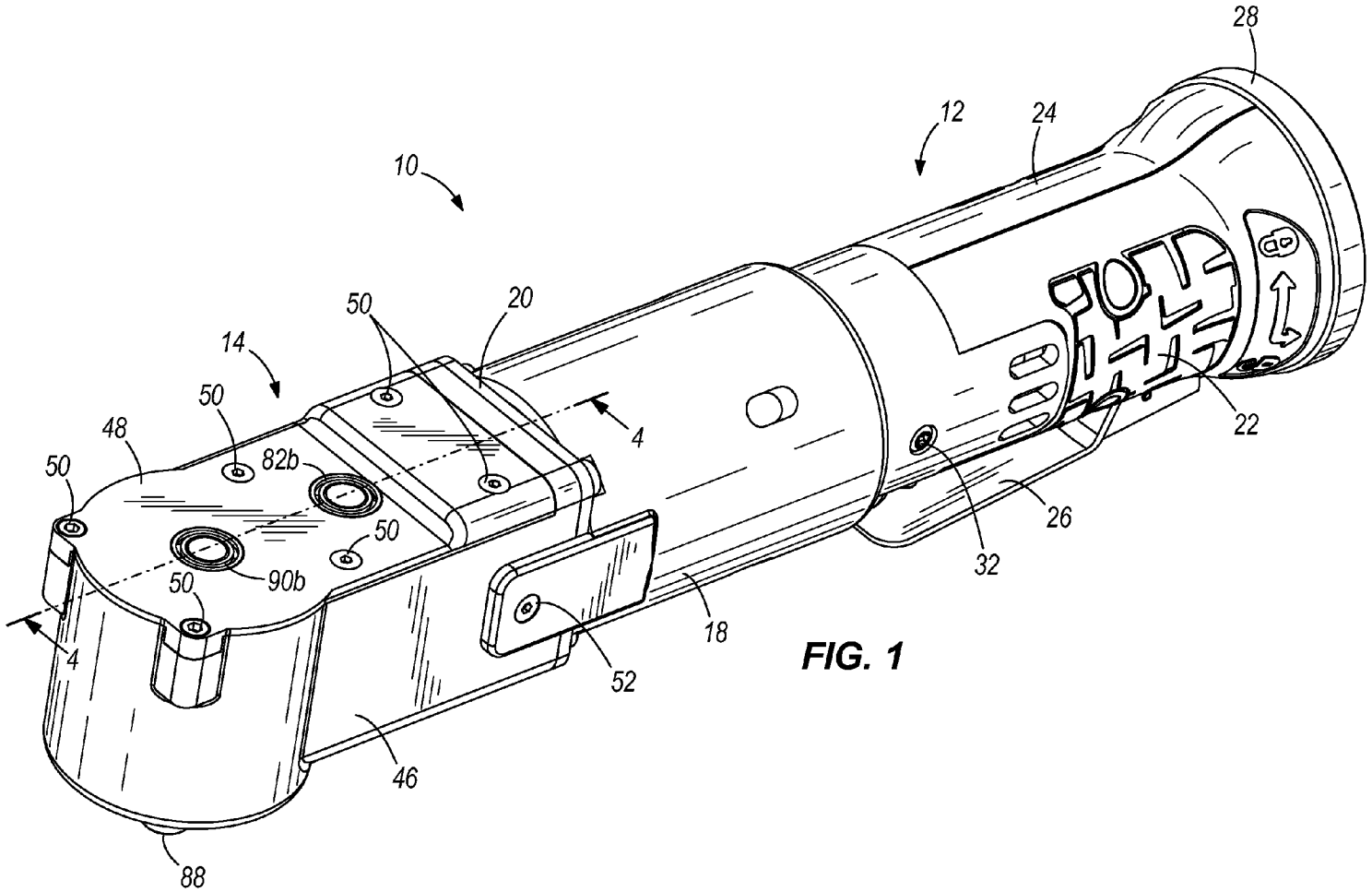
FIG. 1 is a perspective view of an angle impact tool embodying the invention.
Figure 2:
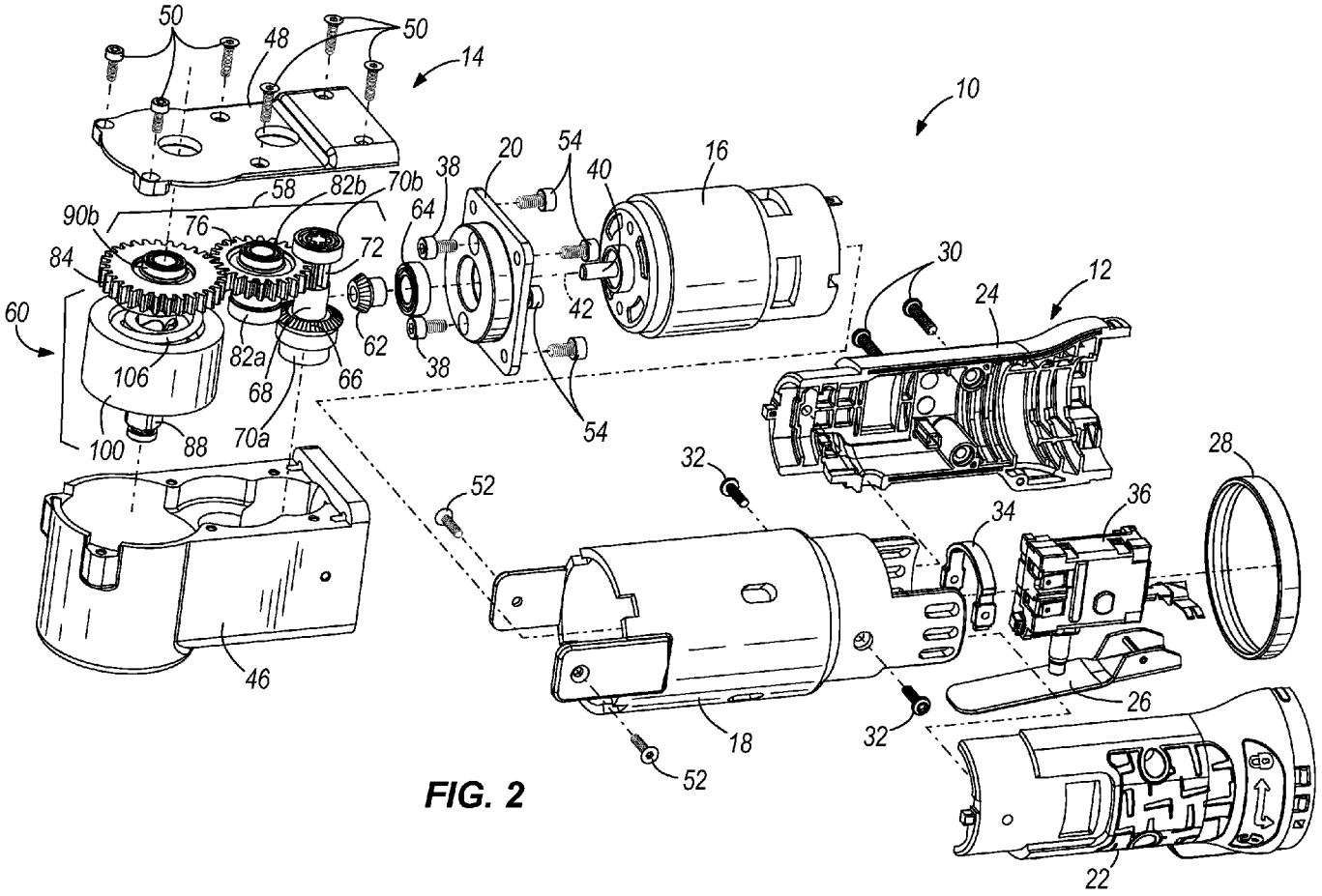
FIG. 2 is an exploded view of the tool of FIG. 1.

FIGS. 1 and 2 illustrate an angle impact tool 10 that includes a handle or motor assembly 12 and a work attachment 14. The illustrated motor assembly 12 includes a motor 16, a motor housing 18, a motor bracket 20, a first grip portion 22, a second grip portion 24, a trigger lever 26, and a lock ring 28. The lock ring 28 and a plurality of fasteners 30 retains the first and second grip portions 22 and 24 together. The motor housing 18 is coupled to the first and second grip portions 22 and 24 by a plurality of fasteners 32 and a U-shaped part 34. A switch 36 is included in the motor assembly 12 between the first and second grip portions 22 and 24. The switch 36 is coupled (mechanically and/or electrically) to the trigger lever 26, such that actuation of the trigger lever 26 causes actuation of the switch 36, and therefore, operation of the motor 16.

The motor bracket 20 is coupled to the motor 16 by a plurality of fasteners 38. The motor 16 includes an output shaft, such as the illustrated rotor 40, that is rotatable about a longitudinal handle axis 42. The illustrated motor 16 is an electric motor, but any suitable prime mover, such as the pneumatic motor disclosed in U.S. Published Application No. 2009/0272554, which is herein incorporated by reference, can be utilized. Although not specifically illustrated, a battery and a directional reverse switch are provided on the angle impact tool 10.

The illustrated work attachment 14 includes an angle housing 46 and an angle housing plate 48. A plurality of fasteners 50 couple the angle housing plate 48 to the angle housing 46. The motor housing 18 is coupled to the angle housing 46 with a plurality of fasteners 52. The motor bracket 20 is coupled to the angle housing 46 by a plurality of fasteners 54.

Figure 4:
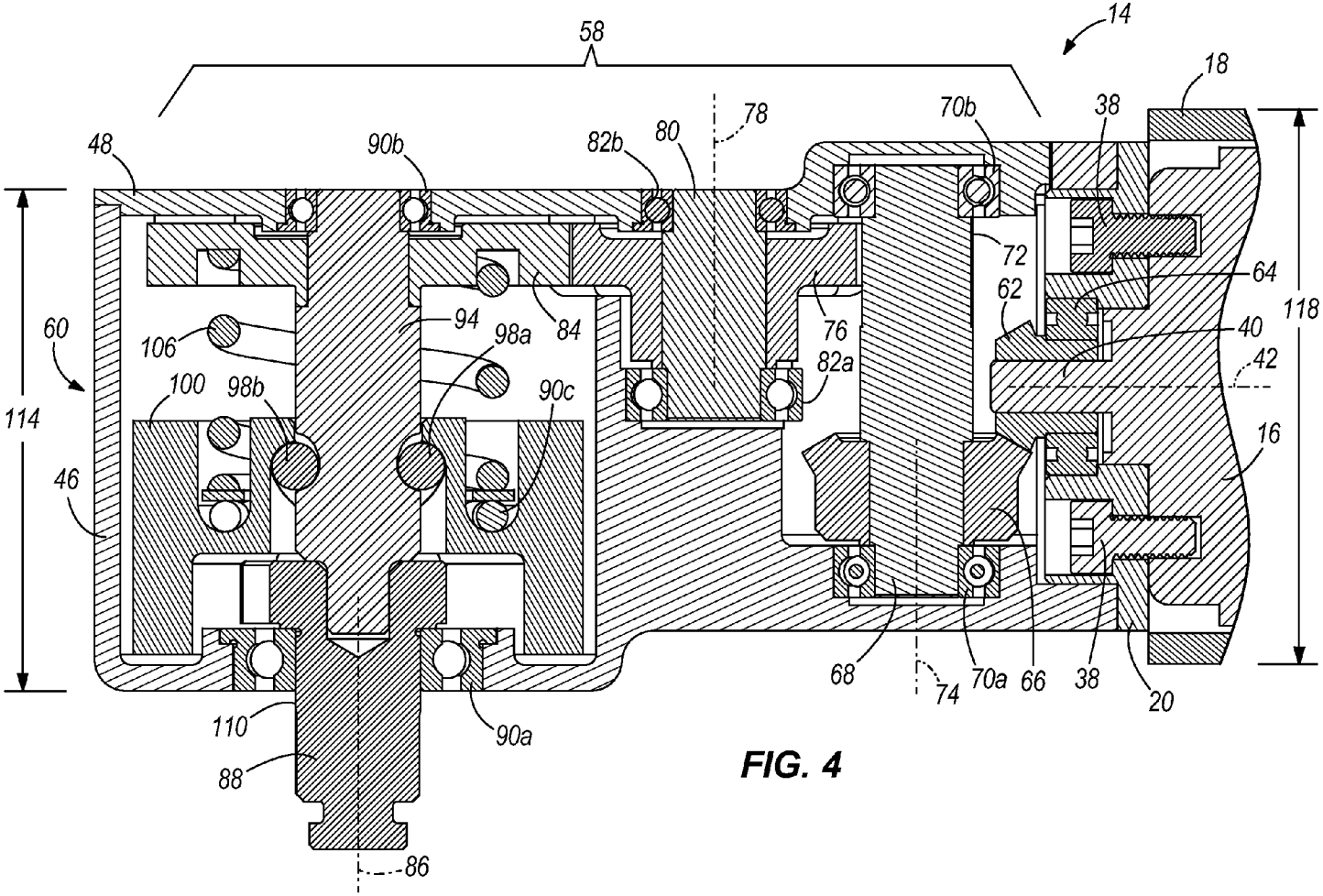
FIG. 4 is a cross-sectional view taken along line 4-4 of FIG. 1.
Figure 5A:
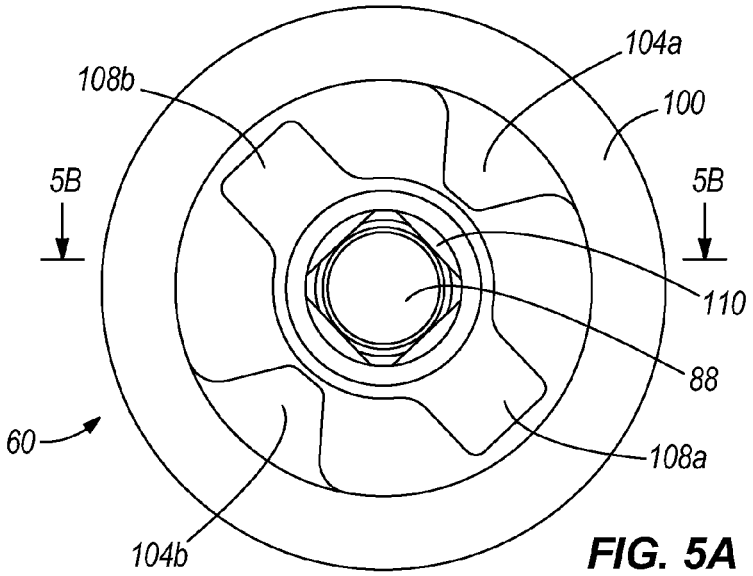
FIGS. 5A-5J illustrate an impact cycle of the impact tool of FIGS. 1-4.
Figure 5B:
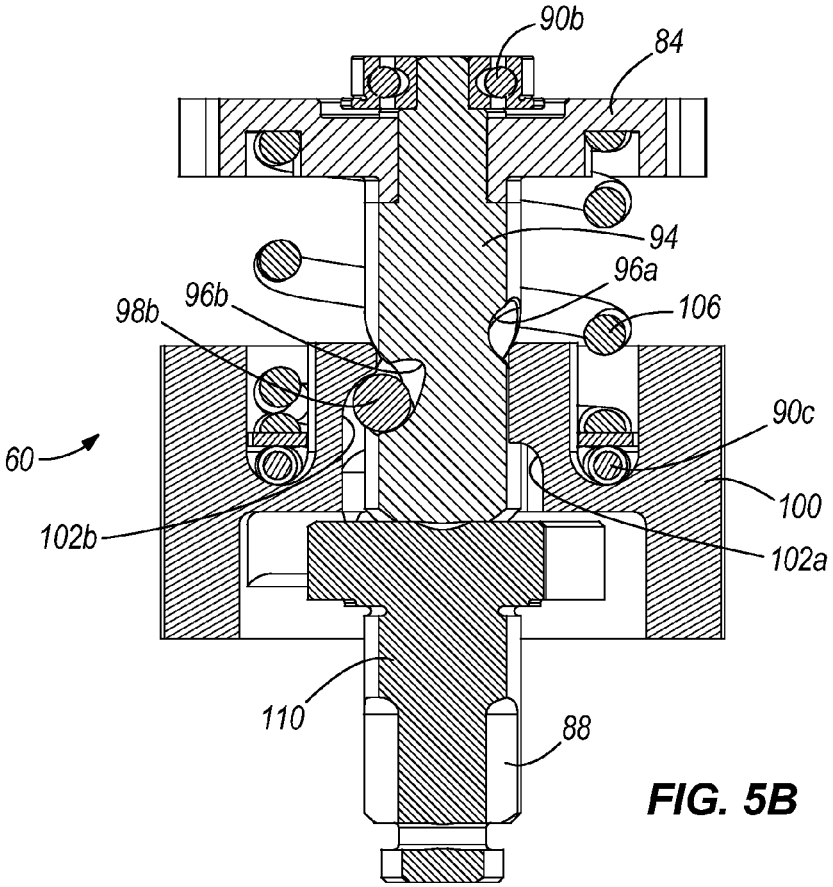
Figure 5C:
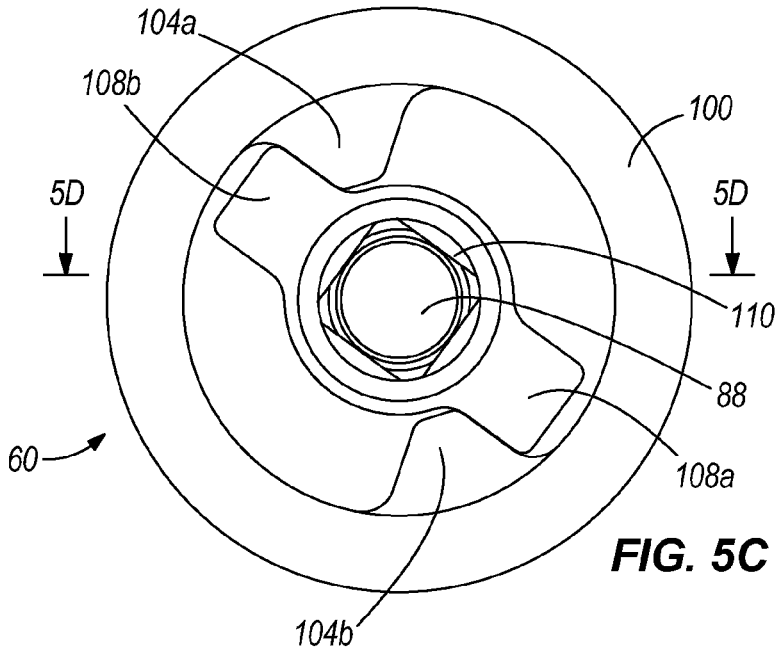
Figure 5D:
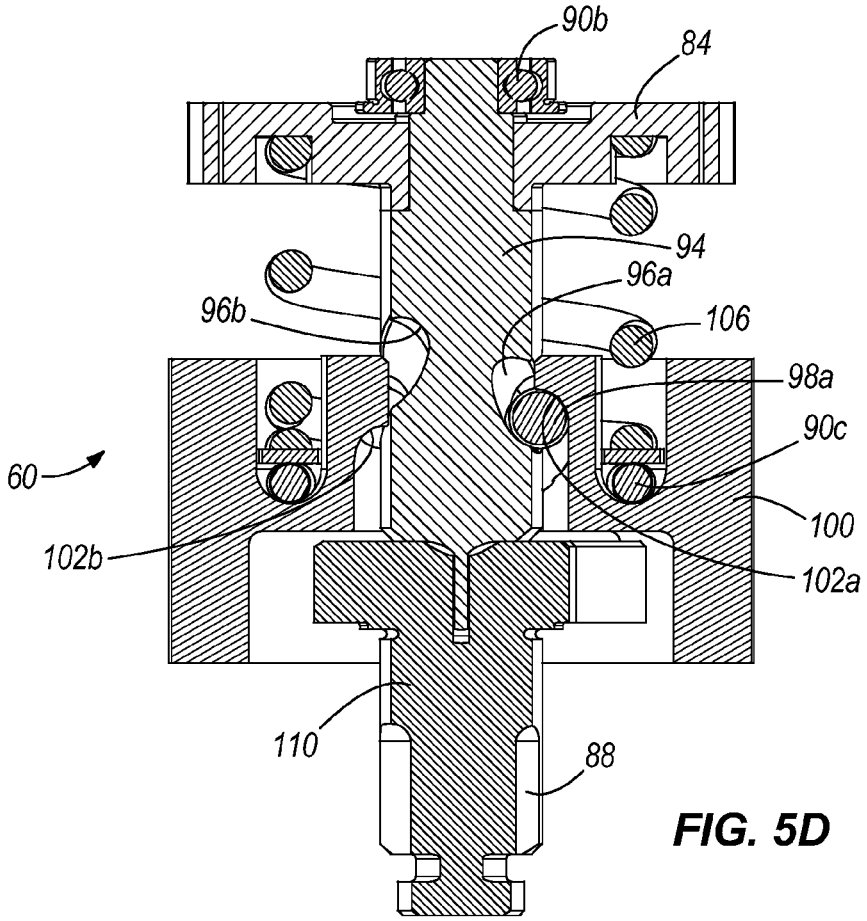
Figure 5E:
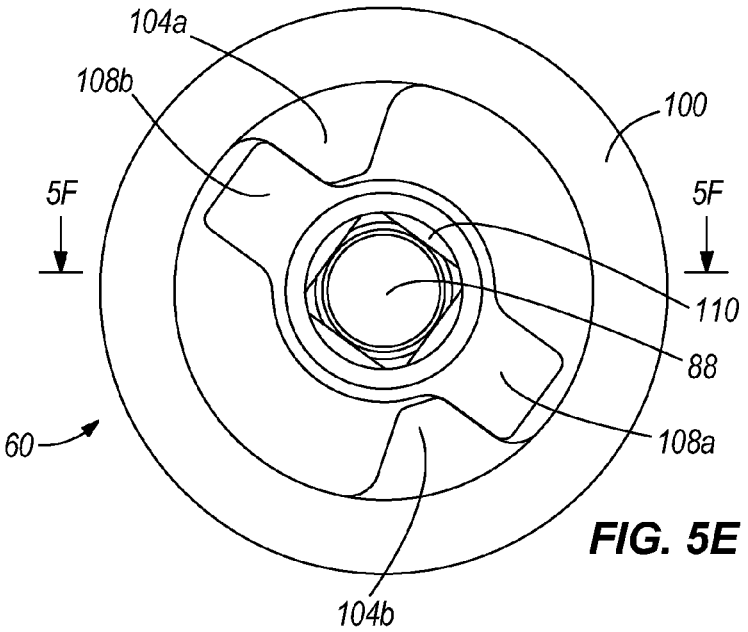
Figure 5F:
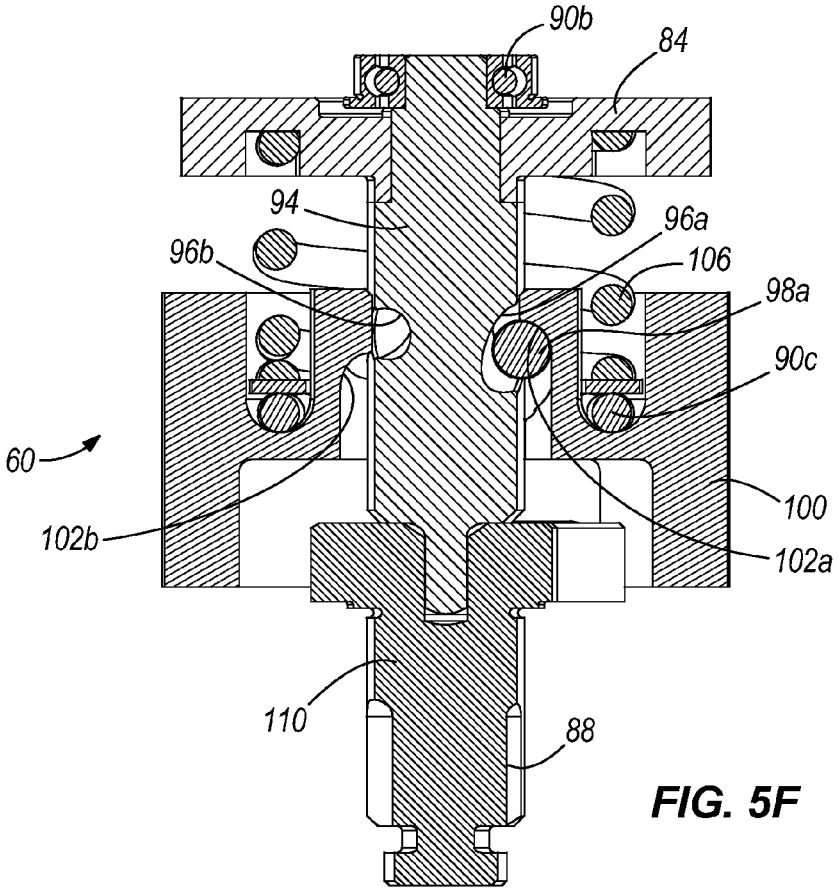
Figure 5G:
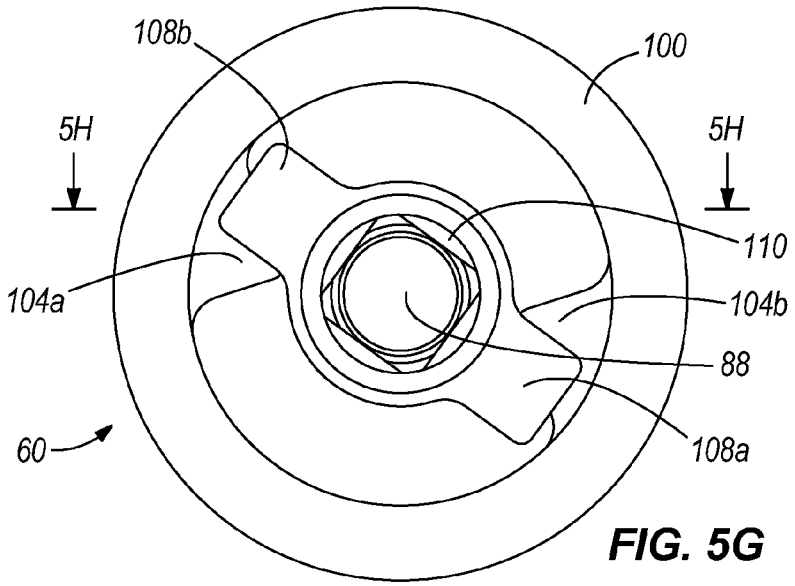
Figure 5H:
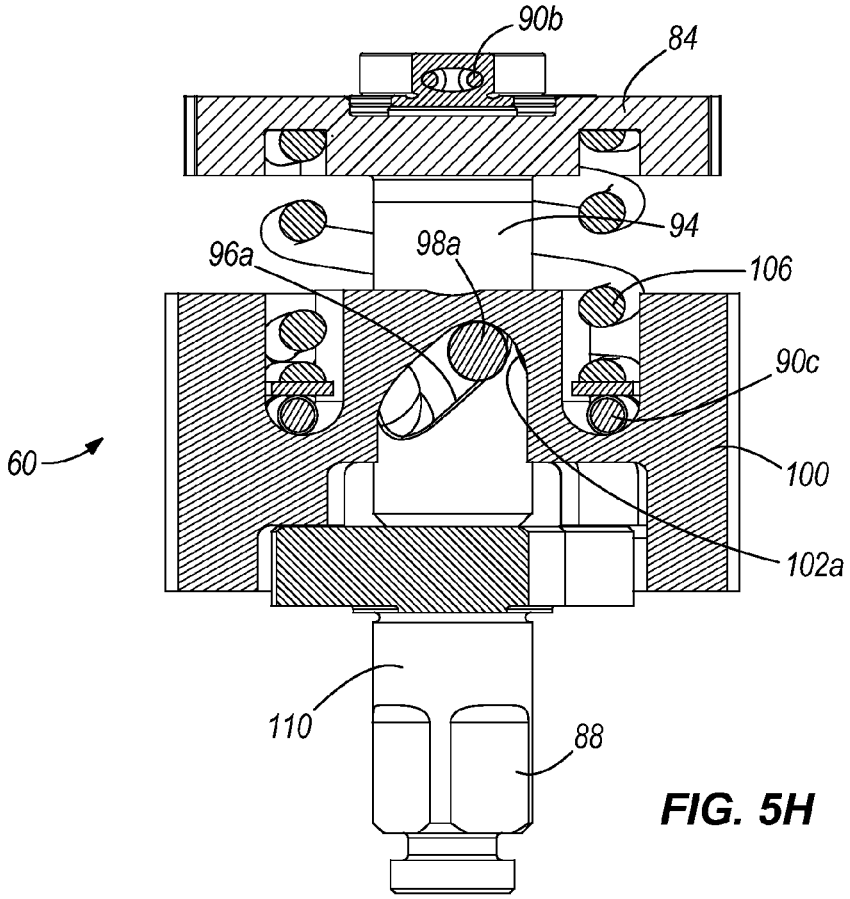
Figure 5I:
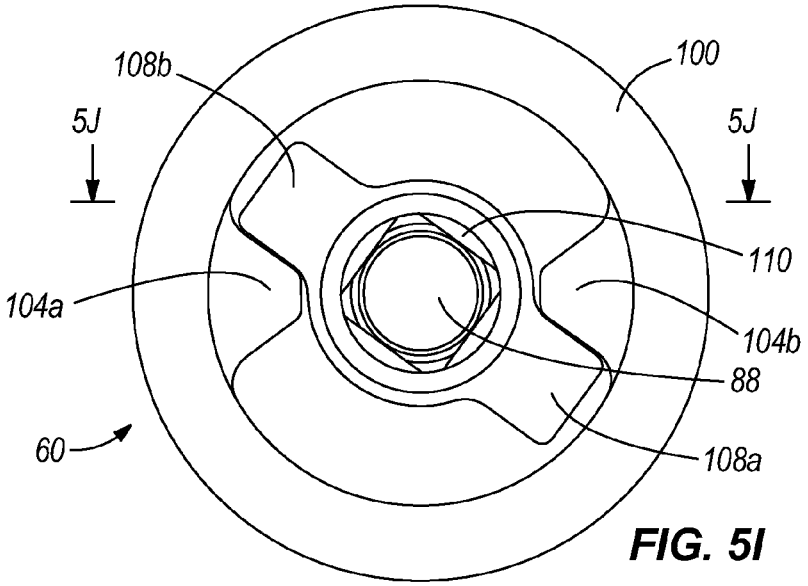
Figure 5J:
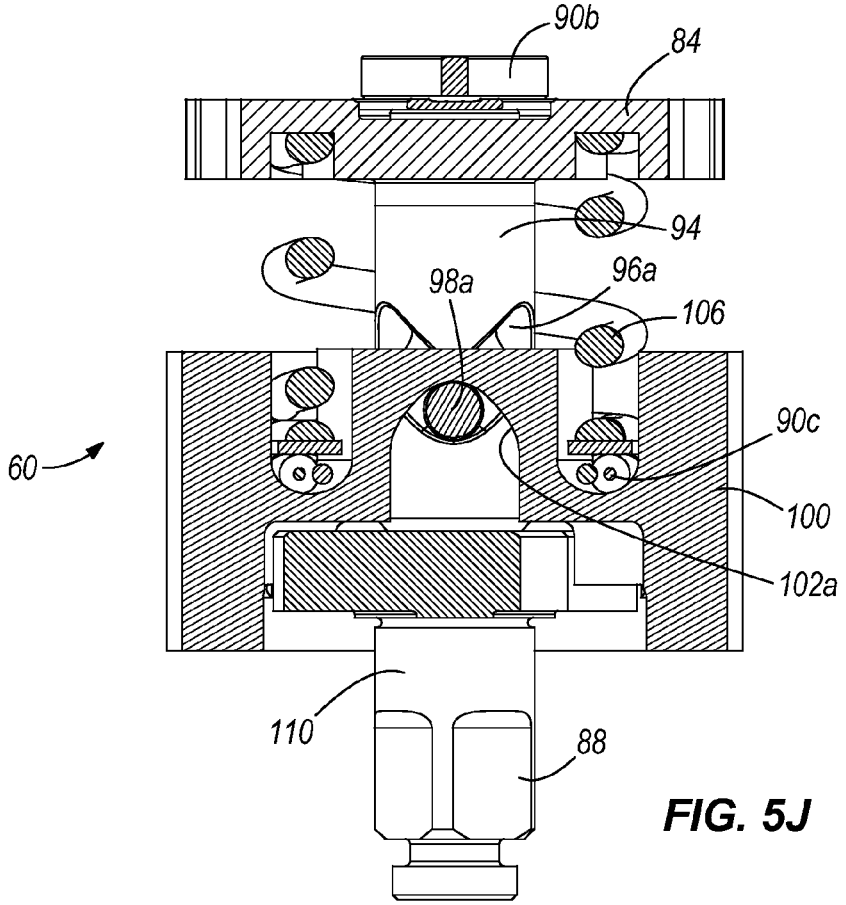

The illustrated work attachment 14 houses a gear assembly 58 and an impact mechanism 60. The gear assembly 58 includes a first bevel gear 62 coupled to the rotor 40 for rotation with the rotor 40 about the longitudinal handle axis 42. A first bearing 64 is positioned between the first bevel gear 62 and the motor bracket 20. The illustrated gear assembly 58 includes a second bevel gear 66 that meshingly engages the first bevel gear 62. The second bevel gear 66 is coupled to a shaft 68 for rotation with the shaft 68. The shaft 68 is supported in the work attachment 14 by bearings 70*a* and 70*b*. The shaft 68 includes a splined portion 72 near bearing 70*b*. The shaft 68 rotates about an axis 74 (FIG. 4). The splined portion 72 functions as a spur gear and in some embodiments, can be replaced with a spur gear.

The splined portion 72 engages a gear, such as a first spur gear 76, such that rotation of the splined portion 72 causes rotation of the first spur gear 76 about an axis 78 (FIG. 4). The first spur gear 76 is coupled to a second shaft 80 for rotation with the second shaft 80 (FIG. 4) about the axis 78. The second shaft 80 is supported for rotation with respect to the work attachment 14 by bearings 82*a*, 82*b*.

The first spur gear 76 meshes with a second spur gear 84 to cause rotation of the second spur gear 84 about an axis 86 (FIG. 4). The second spur gear 84 is coupled to a square drive 88 through the impact mechanism 60 for selectively rotating the square drive 88. The second spur gear 84 and the square drive 88 are supported for rotation within the angle housing 46 by bearings 90*a*, 90*b*, 90*c* (FIG. 4). The axes 74, 78 and 86 are all substantially parallel to each other and are thus each substantially perpendicular to axis 42.

The square drive 88 is connectable to a socket or other fastener-driving output element. In some constructions, the work attachment 14 can be substantially any tool adapted to be driven by a rotating output shaft of the motor 16, including but not limited to an impact wrench, gear reducer, and the like.

Figure 3:
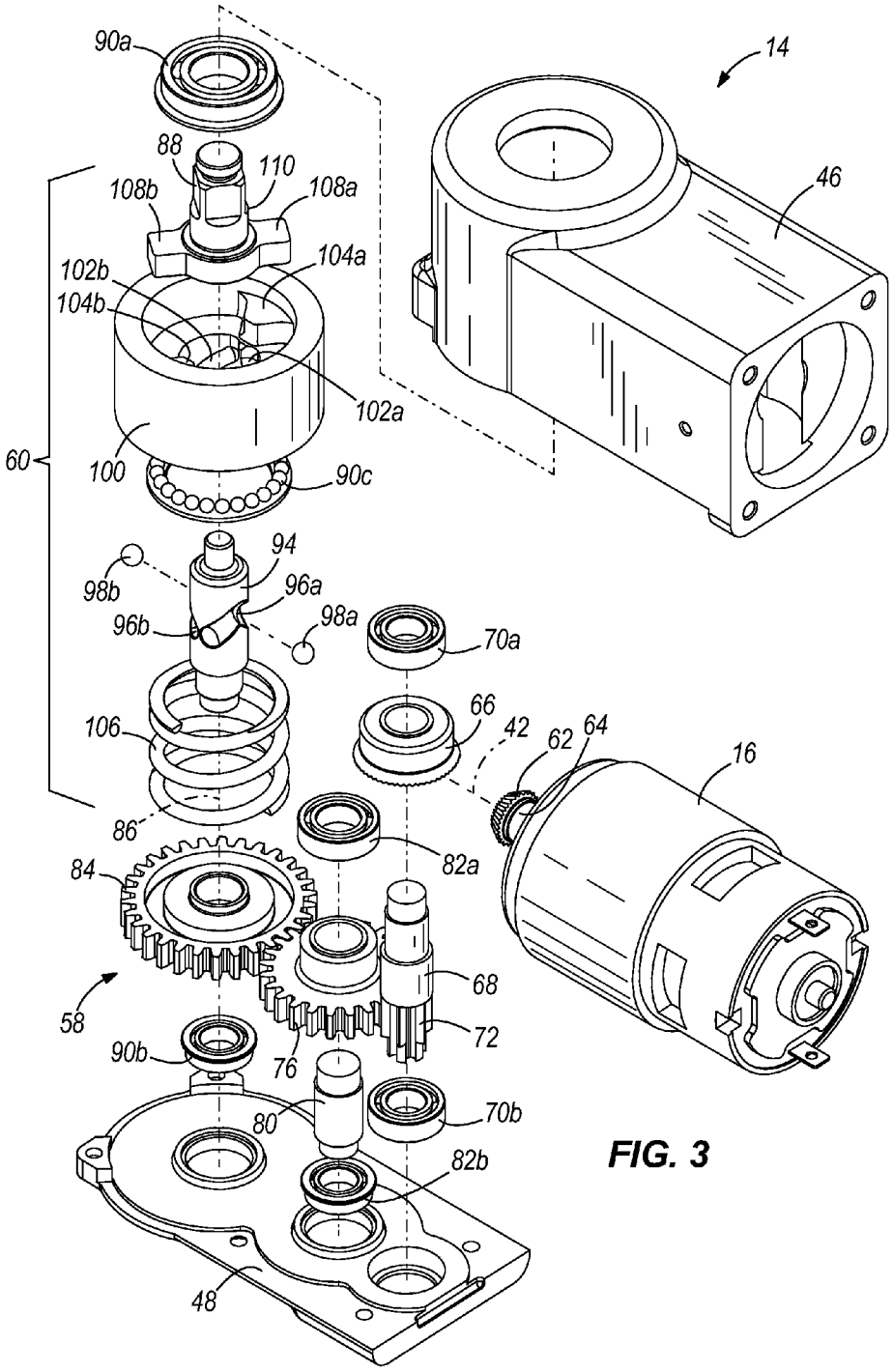
FIG. 3 is an exploded view of an angle head of the tool of FIG. 1.

With reference to FIGS. 2-4, the impact mechanism 60 can be a standard impact mechanism, such as a Potts mechanism or a Maurer mechanism. The illustrated impact mechanism 60 includes a cam shaft 94 coupled to the second spur gear 84 for rotation with the second spur gear 84 about the second axis 86. The illustrated cam shaft 94 includes opposite cam grooves 96*a*, 96*b* that define pathways for respective balls 98*a*, 98*b*. The illustrated impact mechanism 60 further includes a hammer 100 that includes opposite cam grooves 102*a*, 102*b* that are substantially mirror-images of cam grooves 96*a*, 96*b*. The balls 98*a*, 98*b* are retained between the respective cam grooves 96*a*, 96*b*, 102*a*, 102*b*. The hammer 100 also includes first and second opposite jaws 104*a*, 104*b*.

The first bevel gear 62 actuates the gear assembly 58 and the impact mechanism 60 to functionally drive an output, such as the square drive 88, as shown in the illustrated embodiment. The square drive 88 is rotated about the axis 86 which is non-parallel to the axis 42. In the illustrated embodiment, the axis 86 is perpendicular to the axis 42. In other embodiments (not shown), the axis 86 is at an acute or obtuse non-parallel angle to the axis 42.

A biasing member, such as an axial compression spring 106 is positioned between the second spur gear 84 and the hammer 100 to bias the hammer 100 away from the second spur gear 84. In the illustrated embodiment, the spring 106 rotates with the second spur gear 84 and the bearing 90*c* permits the hammer 100 to rotate with respect to the spring 106. Other configurations are possible, and the illustrated configuration is given by way of example only.

The illustrated square drive 88 is formed as a single unitary, monolithic piece with first and second jaws 108*a*, 108*b* to create an anvil 110. The anvil 110 is supported for rotation within the angle housing 46 by the bearing 90*a*. The jaws 104*a*, 104*b* impact respective jaws 108*a*, 108*b* to functionally drive the square drive 88 in response to rotation of the second spur gear 84. The term "functionally drive" is herein defined as a relationship in which the jaws 104*a*, 104*b* rotate to impact the respective jaws 108*a*, 108*b* and thereby cause intermittent rotation of the square drive 88, in response to the impact of jaws 104*a*, 104*b* on the respective jaws 108*a*, 108*b*. The jaws 104*a*, 104*b* intermittently impact the jaws 108*a*, 108*b*, and therefore the jaws 104*a*, 104*b* functionally drive rotation of the square drive 88. Further, any element that directly or indirectly drives rotation of the hammer to impact the anvil may be said to "functionally drive" any element that is rotated by the anvil as a result of such impact.

The impact cycle is repeated twice every rotation and is illustrated in FIGS. 5A-5J in which the jaws 104*a*, 104*b* impact the jaws 108*a*, 108*b*. The spring 106 permits the hammer 100 to rebound after impact and balls 98*a*, 98*b* guide the hammer 100 to ride up around the cam shaft 94, such that jaws 104*a*, 104*b* are spaced axially from jaws 108*a*, 108*b*. The jaws 104*a*, 104*b* are permitted to rotate past the jaws 108*a*, 108*b* after the rebound. FIGS. 5A-5J illustrate an impact cycle of the impact tool of FIGS. 1-4. Two such impact cycles occur per rotation of the hammer 100.

A head height dimension 114 of the work attachment 14 is illustrated in FIG. 4. The head height dimension 114 is the axial distance from the top of the angle housing plate 48 to the bottom of the angle housing 46. The head height dimension 114 is reduced so that the work attachment 14 can fit into small spaces. The motor housing 18 defines a motor housing height dimension 118, as shown in FIG. 4. The head height dimension 114 is smaller than or substantially equal to the motor housing height dimension 118. Such a configuration permits insertion of the tool 10 into smaller spaces than has previously been achievable without compromising torque. In one embodiment, the head height dimension 114 is less than two inches, and the angle impact tool 10 has a maximum torque of about 180 foot-pounds and a rate of rotation of about 7,100 rotations-per-minute.

Figure 6:
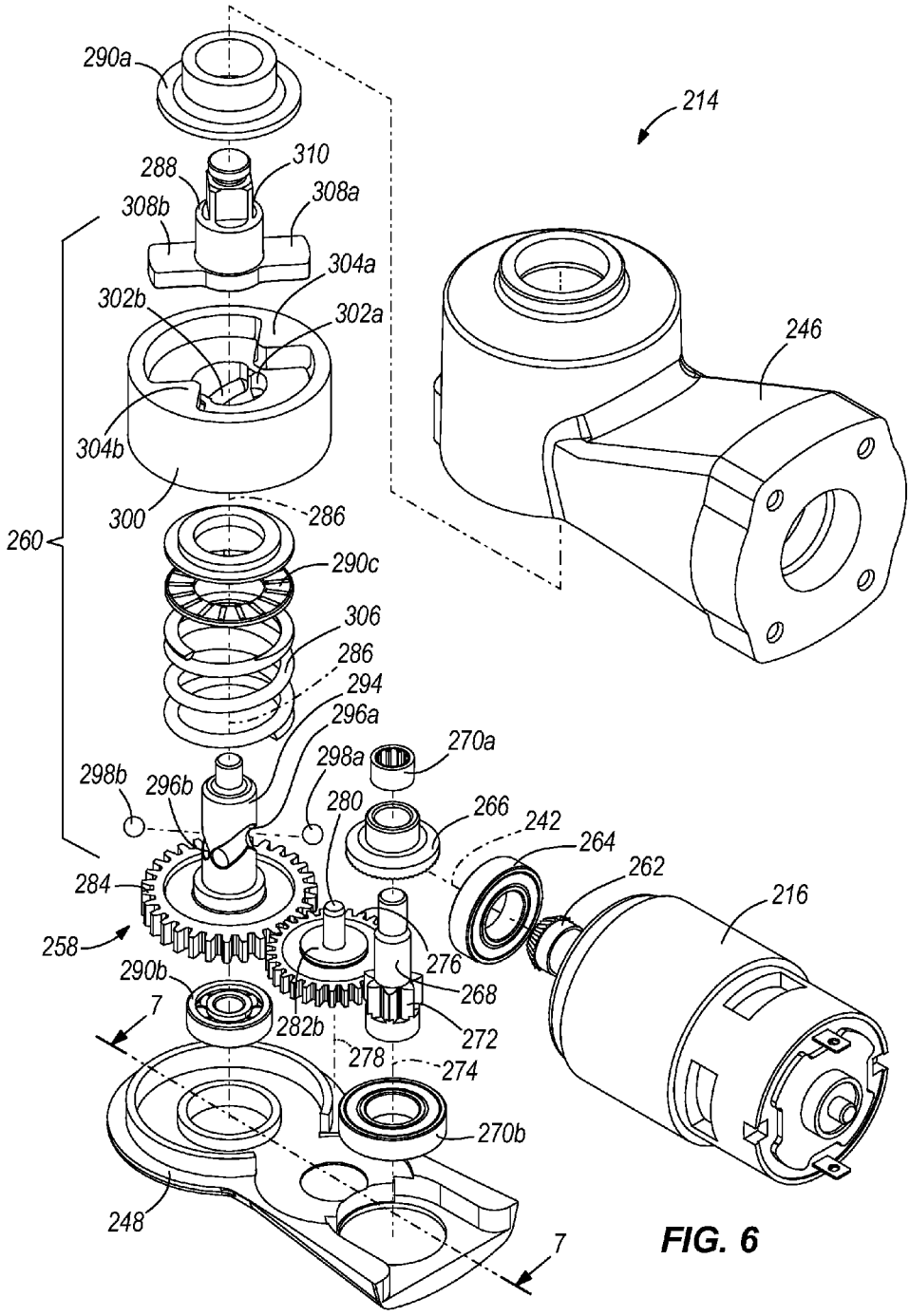
FIG. 6 is an exploded view of another alternate embodiment of an angle head of an impact tool.
Figure 7:
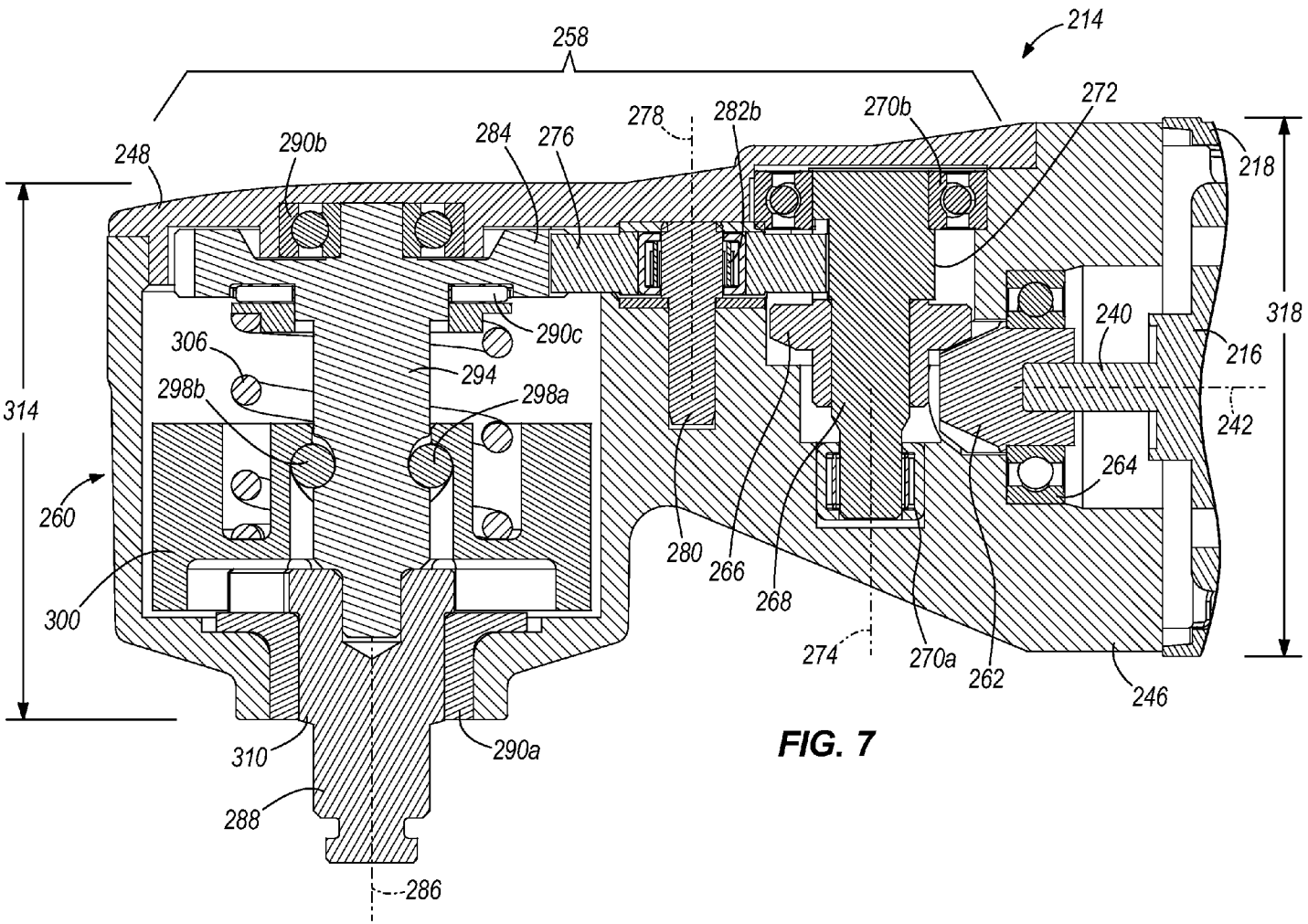
FIG. 7 is a cross-sectional view taken along line 7-7 of FIG. 6.

FIGS. 6 and 7 illustrate an alternate embodiment of an angle head work attachment 214 for an angle impact tool. The angle head work attachment 214 is coupled to a handle and motor 216 having a rotor 240. The motor 216 is supported by a motor housing 218. The illustrated motor 216 is an electric motor, but any suitable prime mover, such as the pneumatic motor disclosed in U.S. Published Application No. 2009/0272554, which is herein incorporated by reference, can be utilized. Although not specifically illustrated, a battery and a directional reverse switch are provided on the angle impact tool.

The angle head work attachment 214 includes an angle housing 246 and an angle housing plate 248 that support a gear assembly 258 and an impact mechanism 260. The rotor 240 rotates about a longitudinal handle axis 242. A first bevel gear 262 is coupled to the rotor 240 for rotation with the rotor 240 about the longitudinal handle axis 242. A first bearing 264 is positioned between the first bevel gear 262 and the motor housing 218. The illustrated gear assembly 258 includes a second bevel gear 266 that meshingly engages the first bevel gear 262. The second bevel gear 266 is coupled to a shaft 268 for rotation with the shaft 268. The shaft 268 is supported in the work attachment 214 by bearings 270*a* and 270*b*. The shaft 268 includes a splined portion 272 near bearing 270*b*. The shaft 268 rotates about an axis 274. The splined portion 272 functions as a spur gear and in some embodiments, can be replaced with a spur gear.

The splined portion 272 engages a gear, such as a first spur gear 276, such that rotation of the splined portion 272 causes rotation of the first spur gear 276 about an axis 278. The first spur gear 276 is coupled to a second shaft 280 for rotation with the second shaft 280 about the axis 278. The second shaft 280 is supported for rotation with respect to the work attachment 214 by bearings 282*b*.

The first spur gear 276 meshes with a second spur gear 284 to cause rotation of the second spur gear 284 about an axis 286. The second spur gear 284 is coupled to a square drive 288 through the impact mechanism 260 for selectively rotating the square drive 288. The second spur gear 284 and the square drive 288 are supported for rotation with respect to the work attachment 214 by bushing 290*a* and bearings 290*b*, 290*c*. The axes 274, 278 and 286 are all substantially parallel to each other and are thus each substantially perpendicular to axis 242.

The square drive 288 is connectable to a socket or other fastener-driving output element. In some constructions, the work attachment 214 can be substantially any tool adapted to be driven by a rotating output shaft of the motor 216, including but not limited to an impact wrench, gear reducer, and the like.

The impact mechanism 260 can be a standard impact mechanism, such as a Potts mechanism or a Maurer mechanism. The illustrated impact mechanism 260 includes a cam shaft 294 coupled to the second spur gear 284 for rotation with the second spur gear 284 about the second axis 286. The illustrated cam shaft 294 includes opposite cam grooves 296*a*, 296*b* that define pathways for respective balls 298*a*, 298*b*. The illustrated impact mechanism 260 further includes a hammer 300 that includes opposite cam grooves 302*a*, 302*b* that are substantially mirror-images of cam grooves 296*a*, 296*b*. The balls 298*a*, 298*b* are retained between the respective cam grooves 296*a*, 296*b*, 302*a*, 302*b*. The hammer 300 also includes first and second opposite jaws 304*a*, 304*b*.

The first bevel gear 262 actuates the gear assembly 258 and the impact mechanism 260 to functionally drive an output, such as the square drive 288, as shown in the illustrated embodiment. The square drive 288 is rotated about the axis 286 which is non-parallel to the axis 242. In the illustrated embodiment, the axis 286 is perpendicular to the axis 242. In other embodiments (not shown), the axis 286 is at an acute or obtuse non-parallel angle to the axis 242.

A biasing member, such as an axial compression spring 306 is positioned between the second spur gear 284 and the hammer 300 to bias the hammer 300 away from the second spur gear 284. In the illustrated embodiment, the spring 306 rotates with the hammer 100 and the bearing 290*c* permits the second spur gear 284 to rotate with respect to the spring 106. Other configurations are possible, and the illustrated configuration is given by way of example only.

The illustrated square drive 288 is formed as a single unitary, monolithic piece with first and second jaws 308*a*, 308*b* to create an anvil 310. The anvil 310 is supported for rotation within the work attachment 214 by the bushing 290*a*. The jaws 304*a*, 304*b* impact respective jaws 308*a*, 308*b* to functionally drive the square drive 288 in response to rotation of the second spur gear 284. The impact cycle is repeated twice every rotation and is similar to the impact cycled illustrated in FIGS. 5A-5J. During the impact cycle, the jaws 304*a*, 304*b* impact the jaws 308*a*, 308*b*. The spring 306 permits the hammer 300 to rebound after impact and balls 298*a*, 298*b* guide the hammer 300 to ride up around the cam shaft 294, such that jaws 304*a*, 304*b* are spaced axially from jaws 308*a*, 308*b*. The jaws 304*a*, 304*b* are permitted to rotate past the jaws 308*a*, 308*b* after the rebound.

A head height dimension 314 of the work attachment 214 is illustrated in FIG. 7. The head height dimension 314 is the axial distance from the top of the angle housing 246 to the bottom of the angle housing 246. The head height dimension 314 is reduced so that the work attachment 214 can fit into small spaces. The motor housing 218 defines a motor housing height dimension 318, as shown in FIG. 7. The head height dimension 314 is smaller than or substantially equal to the motor housing height dimension 318. Such a configuration permits insertion of the tool and the work attachment 214 into smaller spaces than has previously been achievable without compromising torque.

Thus, the invention provides, among other things, an angle impact tool. Various features and advantages of the invention are set forth in the following claims.

What is claimed is:

1. An angle impact tool comprising:

a handle assembly extending generally along a first axis and graspable by a user;

a prime mover having an output shaft rotatable about the first axis;

an output drive functionally coupled to the prime mover and selectively rotatable in response to rotation of the output shaft, the output drive defining an output axis about which the output drive is operable to rotate, wherein the output axis is substantially perpendicular to the first axis;

a first spur gear functionally positioned between the prime mover and an impact mechanism, the first spur gear rotatable in response to rotation of the output shaft;

a second spur gear meshing with the first spur gear for rotation in response to rotation of the first spur gear, wherein a diameter of the second spur gear is greater than a diameter of the first spur gear;

a third spur gear meshing with the second spur gear for rotation in response to rotation of the first and second spur gears, wherein a diameter of the third spur gear is greater than the diameter of the second spur gear;

a first bevel gear coupled to the output shaft for rotation with the output shaft about the first axis;

a second bevel gear functionally positioned between the first bevel gear and the first spur gear, such that rotation of the first bevel gear about the first axis causes rotation of the second bevel gear about a second axis and rotation of the first spur gear about a third axis, wherein the second axis and the third axis are substantially perpendicular to the first axis; and the impact mechanism functionally positioned between the prime mover and the output drive, the impact mechanism operable to selectively drive the output drive in response to rotation of the output shaft, the impact mechanism comprising a hammer functionally coupled to the output shaft for rotation with the output shaft and an anvil functionally coupled to the output drive, the hammer operable to impact the anvil to drive the output drive with impact forces in response to rotation of the output shaft.

2. The angle impact tool of claim 1, wherein the third spur gear is operable to rotate about the output axis, and wherein the hammer and the anvil are each operable to rotate about the output axis.

3. The angle impact tool of claim 1, wherein the impact mechanism is a Potts mechanism.

4. The angle impact tool of claim 3, wherein the hammer is operable to strike the anvil twice per rotation of the hammer.

5. The angle impact tool of claim 1, wherein the output drive, the impact mechanism, the first spur gear, the second spur gear, the third spur gear, and the second bevel gear are each supported in a work attachment coupled to the handle assembly.

6. The angle impact tool of claim 5, wherein the prime mover is supported by a motor housing in the handle assembly, and wherein a head height dimension of the work attachment that extends parallel to the output axis is smaller than a motor housing height dimension of the motor housing that extends parallel to the output axis.

7. The angle impact tool of claim 1, wherein wherein the prime mover is an electric motor.

* * * * *